US005270284A

United States Patent [19]

Kanto et al.

[11] Patent Number: 5,270,284

[45] Date of Patent: Dec. 14, 1993

[54] HEAT TRANSFER SHEET

[75] Inventors: Jumpei Kanto; Koumei Kafuku; Masayuki Nakamura, all of Tokyo, Japan

[73] Assignee: DAI Nippon Insatsu Kabushiki Kaisha, Japan

[21] Appl. No.: 957,485

[22] Filed: Oct. 7, 1992

Related U.S. Application Data

[62] Division of Ser. No. 685,599, Apr. 16, 1991, Pat. No. 5,179,069.

[30] Foreign Application Priority Data

| | | | |
|---|---|---|---|
| Apr. 19, 1990 | [JP] | Japan | 2-104299 |
| Apr. 27, 1990 | [JP] | Japan | 2-110349 |
| Apr. 27, 1990 | [JP] | Japan | 2-110350 |
| Jun. 9, 1990 | [JP] | Japan | 2-150573 |

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,866,029 | 9/1989 | Evans et al. | 503/227 |
| 5,026,679 | 6/1991 | Evans et al. | 428/195 |

*Primary Examiner*—B. Hamilton Hess
*Attorney, Agent, or Firm*—Parkhurst, Wendel & Rossi

[57] ABSTRACT

A heat transfer sheet for use with a sublimation-type heat transfer printing method, capable of producing a high-quality image having high preservability, comprising a substrate sheet, and a dye layer which is formed on one surface of the substrate sheet, the dye layer containing a sublimable dye represented by the formula (I), (II), (III) or (IV) shown below.

(I)

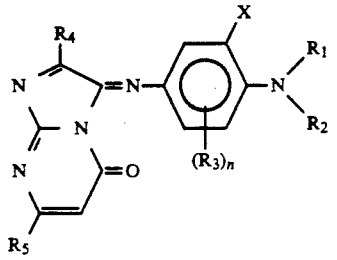

(II)

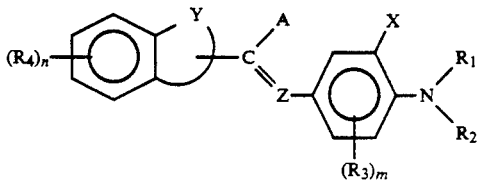

(III)

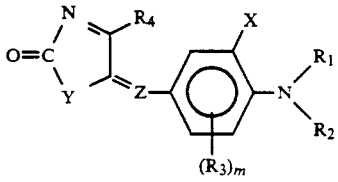

(IV)

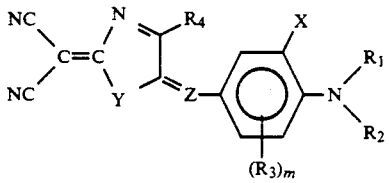

7 Claims, No Drawings

HEAT TRANSFER SHEET

This is a Rule 60 divisional application of Ser. No. 07/685,599 filed Apr. 16, 1991, now abandoned.

BACKGROUND OF THE INVENTION

This invention relates to a heat transfer sheet, and more particularly to a heat transfer sheet capable of producing an image which is excellent in color density, sharpness, and fastness, in particular, preservability.

Heretofore, a variety of heat transfer printing methods have been proposed. Of these, a sublimation-type heat transfer printing method is now prevailing, in which a heat transfer sheet comprising a sublimable dye as a coloring agent (printing agent) which is retained by a substrate sheet such as paper is superposed on a heat transfer image-receiving sheet such as woven cloth of polyester fiber which is receptive to the sublimable dye, and thermal energy is then applied imagewise to the back surface of the heat transfer sheet, whereby the sublimable dye is transferred to the heat transfer image-receiving sheet to produce an image therein.

Recently, a heat transfer printing method of the sublimation-type has been proposed which can produce a full-colored image on an image-receiving sheet such as a sheet of paper or a plastic film. In this method, a thermal head of a printer is employed as a heat application means, and a large number of dots in three or four colors are transferred to the image-receiving sheet in an extremely short heat application time. A full-colored image can thus be successfully reproduced on the image-receiving sheet.

The image thus obtained is very sharp and clear because a dye is used as a coloring agent. Therefore, the heat transfer printing method of this type can produce an excellent half-tone image with continuous gradation, comparable to an image obtained by offset printing or gravure printing. Further, the quality of the image is as high as that of a full-colored photograph.

However, an image produced even by the above printing method is still suffering from the problems of insufficient color density, low preservability, and discoloration which tends to be caused during the preservation thereof over a long period of time.

In order to conduct a high-speed printing, it is required that thermal energy be applied to the heat transfer sheet in an extremely short time of several seconds or less. However, both the sublimable dye contained in the heat transfer sheet, and the heat transfer image-receiving sheet are not sufficiently heated during such a short heat application time. A resulting image, therefore, cannot have sufficiently high color density.

A sublimable dye having high sublimation ability has been developed in order to successfully achieve high-speed heat transfer printing. In general, however, a highly sublimable dye has a low molecular weight. Therefore, when such a dye is employed in a heat transfer sheet, and is transferred to an image-receiving sheet, it tends to easily migrate in the image-receiving sheet, or to bleed out the surface thereof with the passage of time. For this reason, the image produced by the highly sublimable dye has low preservability; more specifically, the image is blurred or its sharpness is reduced during the preservation thereof. In addition, the bled dye stains an article which is brought into contact with the image-receiving sheet.

In order to eliminate the above problems, it may be considered to employ a sublimable dye having a relatively high molecular weight. Such a sublimable dye, however, cannot sublime instantly upon application of heat, so that an image having high color density cannot be obtained by high-speed printing.

SUMMARY OF THE INVENTION

Accordingly, an object of the present invention is to provide a heat transfer sheet for use with a sublimation-type heat transfer printing method, capable of producing an image which is excellent in color density, sharpness, fastness, and, in particular, preservability.

The above object of the invention can be accomplished by any of the following heat transfer sheets:

Namely, the first invention is a heat transfer sheet comprising (i) a substrate sheet, and (ii) a dye layer which is formed on one surface of the substrate sheet, the dye layer containing a sublimable dye represented by the following formula (I):

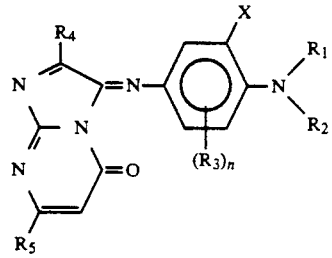

(I)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group; $R_4$ is hydrogen, or a substituted or unsubstituted alkyl, cycloalkyl, aralkyl, aryl or heterocyclic group; $R_5$ is hydrogen, halogen, a cyano group, a nitro group, or a substituted or unsubstituted alkyl, cycloalkyl, alkoxyl, aralkyl, aryl, heterocyclic, acyl, sulfonyl, acylamino, sulfonylamino, ureido, carbamoyl, sulfamoyl or amino group; X is hydrogen, or an atom or atomic group which forms a five- or six-membered ring together with $R_1$; and n is an integer of 1 or 2.

The second invention is a heat transfer sheet comprising (i) substrate sheet, and (ii) a dye layer which is formed on one surface of the substrate sheet, the dye layer containing a sublimable dye represented by the following formula (II):

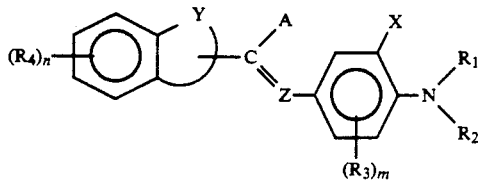

(II)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group; $R_4$ is hydrogen, halogen, a cyano group, a nitro group, or a substituted or unsubstituted alkyl, cycloalkyl, alkoxyl, aralkyl, aryl, heterocyclic, acyl, sulfonyl, acylamino, sulfonylamino, ureido, carbamoyl, sulfamoyl or amino group; X is hydrogen, or an atom or atomic group which forms a five- or six-membered ring together with $R_1$; Y is an aromatic hydrocarbon, or a nitrogen-containing five- or six-membered heterocyclic ring containing 1 to 3 nitrogen atoms; A is an electron attracting group; Z is nitrogen, or a methyne group; m is an integer of 1 or 2; and n is an integer of 1 or 2.

The third invention is a heat transfer sheet comprising (i) a substrate sheet, and (ii) a dye layer which is formed on one surface of the substrate sheet, the dye layer containing a sublimable dye represented by the following formula (III):

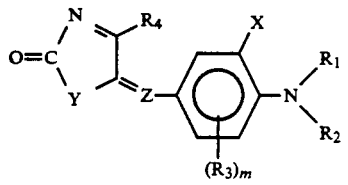

(III)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylmino, sulfonylamino, ureido, carbamoyl, sulfamoyl or amino group; $R_4$ is hydrogen, or a substituted or unsubstituted alkyl, cycloalkyl, alkoxyl, aralkyl, aryl, heterocyclic, acylamino, sulfonylamino or amino group; X is hydrogen, or an atom or atomic group which forms a five- or six-membered ring together with $R_1$; Y is oxygen, or sulfur; Z is nitrogen, or a methyne group; and m is an integer of 1 or 2.

The fourth invention is a heat transfer sheet comprising (i) a substrate sheet, and (ii) a dye layer which is formed on one surface of the substrate sheet, the dye layer containing a sublimable dye represented by the following formula (IV):

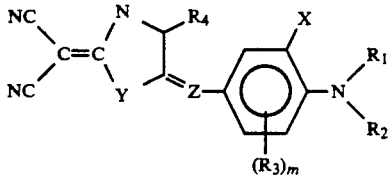

(IV)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylmino, sulfonylamino, ureido, carbamoyl, sulfamoyl or amino group; $R_4$ is hydrogen, or a substituted or unsubstituted alkyl, cycloalkyl, alkoxyl, aralkyl, aryl, heterocyclic, acylamino, sulfonylamino or amino group; X is hydrogen, or an atom or atomic group which forms a five- or six-membered ring together with $R_1$; Y is oxygen, or sulfur; Z is nitrogen, or a methyne group; and m is an integer of 1 or 2.

The dyes having specific structures represented by the above formulae (I), (II), (III) and (IV) are easily transferable to a heat transfer image-receiving sheet upon application of heat even when heat application time is extremely short. Therefore, the heat transfer sheet of the present invention comprising any one of these dyes can produce a high-quality image which is excellent in sharpness, fastness, and, in particular, preservability.

DETAILED DESCRIPTION OF THE PREFERRED EMBODIMENTS

The present invention will now be explained in detail by referring to the preferred embodiments.

The sublimable dye represented by the formula (I) for use in the heat transfer sheet according to the first invention is readily obtainable by a known method. For example, the dye can be prepared by coupling an imidazopyrimidine compound represented by the following formula (a), and a p-phenylene diamine derivative represented by the following formula (b) in the presence of an oxidizing agent such as silver chloride, ammonium peroxosulfate or red prussiate in an alkaline medium:

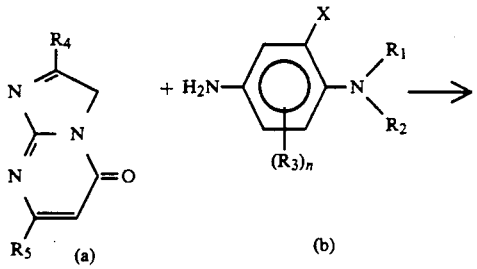

(a) (b)

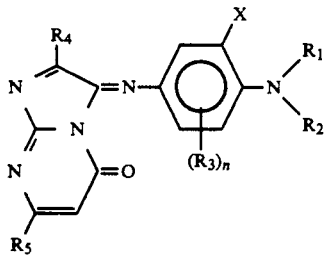

(I)

wherein $R_1$, $R_2$, $R_3$, $R_4$, $R_5$, X, and n are the same as those defined before.

The imidazopyrimidine compound having the above formula (a) is readily obtainable by a known method, for instance, the method described in *J. Heterocyclic Chem.* 22, 601 (1985), or the method described in *J. Am. Chem. Soc*, 82, 1469 (1960).

Preferred examples of groups represented by $R_1$, $R_2$, $R_3$, $R_4$ and $R_5$ of the formula (I) include alkyl groups such as a methyl group, an ethyl group, a propyl group and a butyl group; alkoxyalkyl groups such as a methoxyethyl group and an ethoxyethyl group; hydroxyalkyl groups such as a hydroxyethyl group and β-hydroxypropyl group; halogenoalkyl groups such as a chloroethyl group; cyanoalkyl groups such as a cyanomethyl group and a cyanoethyl group; cycloalkyl groups such as a cyclohexyl group; aralkyl groups such as a benzyl group and a phenethyl group; aryl groups such as a phenyl group, a tolyl group, a halogenophenyl group and an alkoxyphenyl group; hydrogen; halogens such as chlorine, bromine and iodine; a cyano group; a nitro group; acyl groups such as an acetyl group, a propanoyl group and a benzoyl group; acylamino groups such as an acetylamino group and a benzoylamino group; sulfonylamino groups such as a methanesulfonylamino group, an ethanesulfonylamino group and a benzenesulfonylamino group; ureido groups such as a methylureido group, a 1,3-dimethylureido group and an ethylureido group; carbamoyl groups such as a methylcarbamoyl group, an ethylcarbamoyl group and a phenylcarbamoyl group; sulfamoyl groups such as a methylsulfamoyl group, an ethylsulfamoyl group and a phenylsulfamoyl group; amino groups such as a methylamino group, an ethylamino group, a propylamino group, a dimethylamino group and a diethylamino group; and heterocyclic groups such as a furyl group, a thienyl group, a pyrrolyl group, a pyrazolyl group, an imidazolyl group, a pyridyl group, a thiazolyl group and an oxazolyl group.

It is preferable that the molecular weight of the dye for use in the heat transfer sheet of the first invention be in the range of from 300 to 600.

Listed below in Table A-1 are specific examples of the dye having the formula (I), which are favorably employed in the heat transfer sheet of the first invention. Note that all dyes shown in the table, except Dyes No. 29 and No. 30, have hydrogen as "X" of the formula (I).

TABLE A-1

| No. | $R_1$ | $R_2$ | $R_3$ (n = 1) | $R_4$ | $R_5$ | M. W. |
|---|---|---|---|---|---|---|
| 1 | $-C_2H_5$ | $-C_2H_5$ | $-CH_3$ | $-Ph$ | $-CH_3$ | 399.5 |
| 2 | $-C_2H_5$ | $-C_2H_5$ | $-OC_2H_5$ | $-Ph$ | $-H$ | 415.5 |
| 3 | $-C_2H_5$ | $-C_2H_4OH$ | $-OC_2H_5$ | $-Ph$ | $-CH_3$ | 445.5 |
| 4 | $-C_2H_5$ | $-C_2H_5$ | $-NHCOCH_3$ | $-Ph$ | $-CH_3$ | 442.5 |
| 5 | $-C_2H_5$ | $-C_2H_5$ | $-OC_2H_5$ | $-CH_3$ | $-CH_3$ | 367.5 |
| 6 | $-C_2H_5$ | $-CH_2Ph$ | $-OC_2H_5$ | -thienyl | $-Ph$ | 559.6 |
| 7 | $-C_2H_5$ | $-C_2H_5$ | $-OC_2H_5$ | $-CH_2Ph$ | $-OC_2H_5$ | 473.6 |
| 8 | $-C_2H_5$ | $-C_2H_4CN$ | $-NHCOCH_3$ | -thienyl | $-NHCOCH_3$ | 516.5 |
| 9 | $-C_2H_5$ | $-C_2H_5$ | $-OC_2H_5$ | $-H$ | -thienyl | 421.4 |
| 10 | $-C_2H_5$ | $-C_2H_4NHSO_2CH_3$ | $-OC_2H_5$ | -furyl | $-CONHCH_3$ | 555.5 |
| 11 | $-C_2H_5$ | $-Ph$ | $-CH_3$ | $-H$ | $-CN$ | 382.4 |
| 12 | $-C_2H_5$ | $-C_2H_5$ | $-OC_2H_5$ | $-Ph$ | $-Ph$ | 491.6 |
| 13 | $-C_2H_5$ | $-C_2H_5$ | $-OC_2H_5$ | $-Ph$ | $-NHSO_2CH_3$ | 508.6 |
| 14 | $-C_2H_5$ | $-C_2H_5$ | $-H$ | $-Ph$ | $-CH_3$ | 385.5 |
| 15 | $-C_2H_5$ | $-C_2H_5$ | $-NHCOCH_3$ | -thiazolyl | $-CH_3$ | 449.4 |
| 16 | $-C_2H_4OCH_3$ | $-C_2H_5$ | $-NHCOCH_3$ | $-CH_3$ | $-CH_3$ | 409.5 |
| 17 | $-C_2H_4OCH_3$ | $-C_2H_4OCH_3$ | $-NHCOCH_3$ | $-CH_3$ | $-CH_3$ | 439.5 |
| 18 | $-C_2H_4OCH_3$ | $-C_2H_4OCH_3$ | $-NHCOCH_3$ | $-Ph$ | $-CH_3$ | 501.6 |
| 19 | $-C_2H_4OCOCH_3$ | $-C_2H_5$ | $-NHCOCH_3$ | $-CH_3$ | $-CH_3$ | 437.5 |
| 20 | $-C_2H_4OCOCH_3$ | $-C_2H_4OCOCH_3$ | $-NHCOCH_3$ | $-CH_3$ | $-CH_3$ | 495.5 |
| 21 | $-C_2H_4OCH_3$ | $-C_2H_5$ | $-CH_3$ | $-Ph$ | $-CH_3$ | 428.5 |
| 22 | $-C_2H_4OCH_3$ | $-C_2H_4OCH_3$ | $-CH_3$ | $-Ph$ | $-CH_3$ | 458.5 |
| 23 | $-C_2H_4OCOCH_3$ | $-C_2H_5$ | $-CH_3$ | $-Ph$ | $-CH_3$ | 456.5 |
| 24 | $-C_2H_4OCOCH_3$ | $-C_2H_4OCOCH_3$ | $-CH_3$ | $-Ph$ | $-CH_3$ | 514.6 |
| 25 | $-C_2H_4OCH_3$ | $-C_2H_4OCH_3$ | $-NHSO_2CH_3$ | $-CH_3$ | $-CH_3$ | 475.5 |
| 26 | $-C_2H_4OCOCH_3$ | $-C_2H_4OCOCH_3$ | $-NHSO_2CH_3$ | $-CH_3$ | $-CH_3$ | 531.6 |
| 27 | *1 | | $-NHCOCH_3$ | $-CH_3$ | $-CH_3$ | 393.4 |
| 28 | *2 | | $-NHCOCH_3$ | $-CH_3$ | $-CH_3$ | 377.4 |
| 29 | *3 | $-C_2H_5$ | $-NHCOCH_3$ | $-CH_3$ | $-CH_3$ | 391.5 |
| 30 | *3 | $-C_2H_5$ | $-NHSO_2CH_3$ | $-Ph$ | $-CH_3$ | 489.6 |

[NOTE]

*1 $R_1$ and $R_2$ are combined with each other to give the following ring:

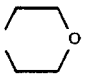

*2 $R_1$ and $R_2$ are combined with each other to give the following ring:

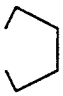

*3 $R_1$ and X are combined with each other to give the following ring:

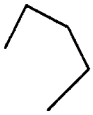

The heat transfer sheet according to the first invention produces an image of cyan in color. Therefore, when it is used together with heat transfer sheets which can respectively produce images of yellow and magenta in color, a full-colored image is obtainable with high reproducibility.

The following heat transfer sheets are preferably employed along with the heat transfer sheet of the first invention to produce an excellent full-colored image:

(i) A heat transfer sheet comprising a yellow dye represented by the following formula:

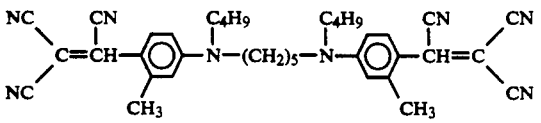

(ii) A heat transfer sheet comprising a magenta dye represented by the following formula:

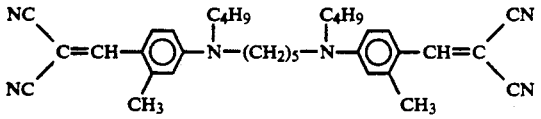

The sublimable dye represented by the formula (II) for use in the heat transfer sheet according to the second invention is readily obtainable by a known method. For example, the dye can be prepared by subjecting a benzothiazole compound represented by the following formula (a), and a nitroso compound represented by the following formula (b) of an aldehyde compound represented by the following formula (c) to a dehydration condensation reaction in the presence of an acid, base, or acid-base catalyst:

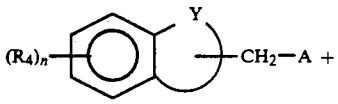

(a)

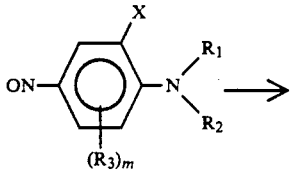

(c)

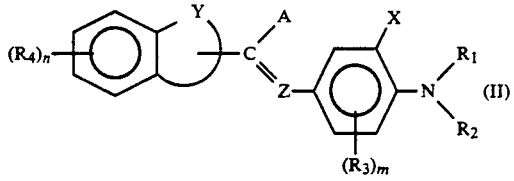

(II)

wherein $R_1$, $R_2$, $R_3$, $R_4$, A, X, Y, m, and n are the same as those defined before.

Preferred examples of groups represented by $R_1$ and $R_2$ of the formula (II) include alkyl groups such as a methyl group, an ethyl group, a propyl group and a butyl group; alkoxyalkyl groups such as a methoxyethyl group and an ethoxyethyl group; hydroxyalkyl groups such as a hydroxyethyl group and $\beta$-hydroxypropyl group; halogenoalkyl groups such as a chloroethyl group; cyanoalkyl groups such as a cyanomethyl group and a cyanoethyl group; cycloalkyl groups such as a cyclohexyl group; aralkyl groups such as a benzyl group and a phenethyl group; and aryl groups such as a phenyl group, a tolyl group, a halogenophenyl group and an alkoxyphenyl group.

Preferred examples of a group represented by $R_3$ of the formula (II) include hydrogen; halogens such as chlorine, bromine and iodine; a cyano group; the above-enumerated alkyl, hydroxyalkyl, halogenoalkyl, cyanoalkyl, cycloalkyl, alkoxyl, aralkyl, aryl and carboxyl groups; acyl groups such as an acetyl group, a propanoyl group and a benzoyl group; acylamino groups such as an acetylamino group and a benzoylamino group; alkylsulfonyl groups such as a methanesulfonyl group and an ethanesulfonyl group; ureido groups such as a methylureido group, a 1,3-dimethylureido group and an ethylureido group; carbamoyl groups such as a methylcarbamoyl group, an ethylcarbamoyl group and a phenylcarbamoyl group; sulfamoyl groups such as a methylsulfamoyl group, an ethylsulfamoyl group and a phenylsulfamoyl group; amino groups such as a methylamino group, an ethylamino group, a propylamino group, a dimethylamino group and a diethylamino group. Preferred examples of a group represented by $R_4$ include those groups which are enumerated above as the examples of a group represented by $R_3$, and a nitroso group.

Preferred examples of a group represented by Y include rings such as benzene, pyrrole, pyrazole, imidazole, oxazole, thiazole, pyridine, pyridazine, pyrimidine and pyrazine.

Preferred examples of a group represented by A include a cyanoamino group; a carboxyl group; the above-described acyl groups; alkylsulfonyl groups such as a methanesulfonyl group and an ethanesulfonyl group; arylsulfonyl groups such as a phenylsulfonyl group and p-chlorophenylsulfonyl group; the above-described carbamoyl groups and sulfamoyl groups; alkoxycarbonyl groups such as a methoxycarbonyl group, an ethoxycarbonyl group and a propoxycarbonyl group; and aryloxycarbonyl groups such as a phenoxycarbonyl group and a p-methylphenoxycarbonyl group.

It is preferable that the molecular weight of the dye for use in the heat transfer sheet of the second invention be in the range of from 300 to 500.

Of the dyes represented by the formula (II), those dyes represented by the below-described formula (A) are specifically shown in Table B-1; those dyes represented by the below-described formula (B) are specifically shown in Table B-3; and specific examples of the other dyes are shown in Tables B-2 and B-4. In Tables B-1 and B-3, the dyes are enumerated by showing groups which are represented by $R_1$, $R_2$, $R_3$, $R_4$ and $R_5$ of the formula (A) or (B), and their molecular weights, instead of showing their chemical formulae. Note that both n and m of the formula (A) or (B) are 1.

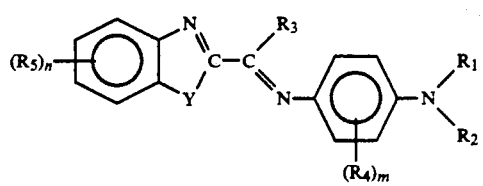

(A)

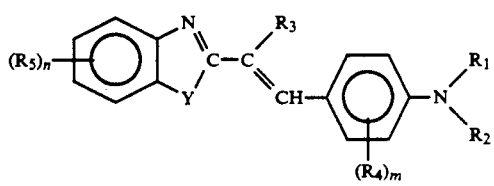

(B)

TABLE B-1

| No. | Y | $R_1$ | $R_2$ | $R_3$ | $R_4$ | $R_5$ | M. W. |
|---|---|---|---|---|---|---|---|
| 1 | >NH | $-C_2H_5$ | $-C_2H_5$ | $-CN$ | $-H$ | $-H$ | 317.4 |
| 2 | >NH | $-C_2H_5$ | $-C_2H_4OH$ | $-CN$ | $-CH_3$ | $-H$ | 347.5 |
| 3 | >NH | $-C_2H_5$ | $-C_2H_5$ | $-CN$ | $-NHCOCH_3$ | $-H$ | 374.5 |
| 4 | >NH | $-C_2H_5$ | $-C_2H_5$ | $-CN$ | $-OC_2H_5$ | $-H$ | 361.5 |
| 5 | >NH | $-C_2H_5$ | $-CH_2Ph$ | $-CONHCH_3$ | $-NHCOCH_3$ | $-Cl$ | 503.0 |
| 6 | >NH | $-C_2H_5$ | $-Ph$ | $-COOCH_3$ | $-NHCOCH_3$ | $-CH_3$ | 469.6 |
| 7 | >NH | $-C_2H_5$ | $-C_2H_4Cl$ | $-CN$ | $-CH_3$ | $-H$ | 365.9 |
| 8 | >$NCH_3$ | $-C_2H_5$ | $-C_2H_5$ | $-CN$ | $-H$ | $-H$ | 331.5 |
| 9 | >$NCH_3$ | $-C_2H_5$ | $-C_2H_4OCH_3$ | $-CN$ | $-CH_3$ | $-H$ | 375.5 |
| 10 | >S | $-C_2H_5$ | $-C_2H_5$ | $-CN$ | $-CH_3$ | $-H$ | 348.5 |
| 11 | >S | $-C_2H_5$ | $-C_2H_5$ | $-SO_2NHC_2H_5$ | $-CH_3$ | $-H$ | 430.6 |
| 12 | >S | $-C_2H_5$ | $-C_2H_5$ | $-SO_2Ph$ | $-H$ | $-H$ | 449.6 |
| 13 | >S | $-C_2H_5$ | $-C_2H_5$ | $-CN$ | $-CH_3$ | $-NHCOCH_3$ | 405.6 |
| 14 | >S | $-C_2H_5$ | $-C_2H_4CN$ | $-CN$ | $-CH_3$ | $-CN$ | 398.5 |
| 15 | >O | $-C_2H_5$ | $-C_2H_5$ | $-CN$ | $-CH_3$ | $-H$ | 332.4 |

TABLE B-2

No. 16

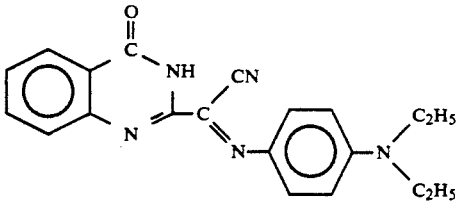

M.W. 345.4

No. 17

TABLE B-2-continued

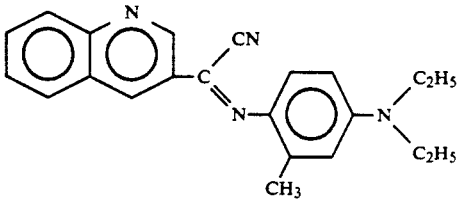

M.W. 342.4

No. 18

TABLE B-2-continued

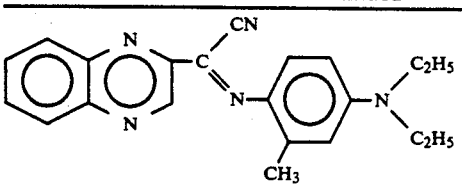

M.W. 343.4

No. 19

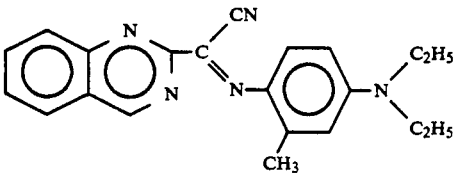

M.W. 343.4

No. 20

TABLE B-2-continued

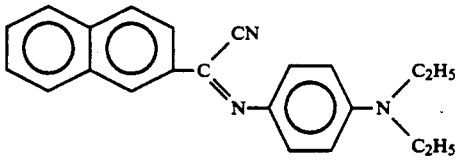

M.W. 327.4

No. 21

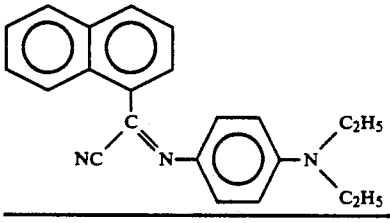

M.W. 327.4

TABLE B-3

| No. | Y | $R_1$ | $R_2$ | $R_3$ | $R_4$ | $R_5$ | M. W. |
|---|---|---|---|---|---|---|---|
| 22 | >O | $-C_2H_5$ | $-C_2H_5$ | $-CN$ | $-H$ | $-H$ | 316.4 |
| 23 | >NH | $-C_2H_5$ | $-C_2H_4OH$ | $-CN$ | $-CH_3$ | $-H$ | 346.5 |
| 24 | >NH | $-C_2H_5$ | $-C_2H_5$ | $-CN$ | $-NHCOCH_3$ | $-H$ | 373.5 |
| 25 | >NH | $-C_2H_5$ | $-C_2H_5$ | $-CN$ | $-OC_2H_5$ | $-H$ | 360.5 |
| 26 | >NH | $-C_2H_5$ | $-CH_2Ph$ | $-CONHCH_3$ | $-NHCOCH_3$ | $-Cl$ | 502.0 |
| 27 | >NH | $-C_2H_5$ | $-Ph$ | $-COOCH_3$ | $-NHCOCH_3$ | $-CH_3$ | 468.6 |
| 28 | >NH | $-C_2H_5$ | $-C_2H_4Cl$ | $-CN$ | $-CH_3$ | $-H$ | 364.9 |
| 29 | >$NCH_3$ | $-C_2H_5$ | $-C_2H_5$ | $-CN$ | $-H$ | $-H$ | 330.5 |
| 30 | >$NCH_3$ | $-C_2H_5$ | $-C_2H_4OCH_3$ | $-CN$ | $-CH_3$ | $-H$ | 374.5 |
| 31 | >S | $-C_2H_5$ | $-C_2H_5$ | $-CN$ | $-H$ | $-H$ | 333.5 |
| 32 | >S | $-C_2H_5$ | $-C_2H_5$ | $-SO_2NHC_2H_5$ | $-CH_3$ | $-H$ | 429.6 |
| 33 | >S | $-C_2H_5$ | $-C_2H_5$ | $-SO_2Ph$ | $-H$ | $-H$ | 448.6 |
| 34 | >S | $-C_2H_5$ | $-C_2H_5$ | $-CN$ | $-CH_3$ | $-NHCOCH_3$ | 404.6 |
| 35 | >S | $-C_2H_5$ | $-C_2H_4CN$ | $-CN$ | $-CH_3$ | $-CN$ | 397.5 |

TABLE B-3-continued

| No. | Y | $R_1$ | $R_2$ | $R_3$ | $R_4$ | $R_5$ | M. W. |
|---|---|---|---|---|---|---|---|
| 36 | >O | $-C_2H_5$ | $-C_2H_5$ | $-CN$ | $-CH_3$ | $-H$ | 331.4 |

TABLE B-4

No. 37

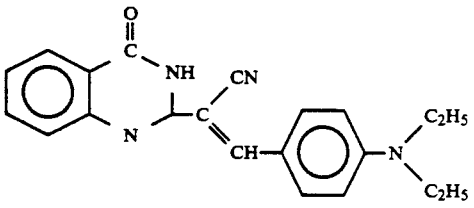

M.W. 344.4

No. 38

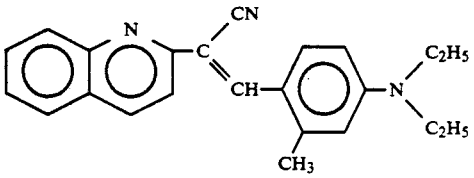

M.W. 341.4

No. 39

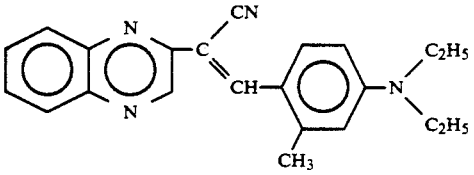

M.W. 342.4

No. 40

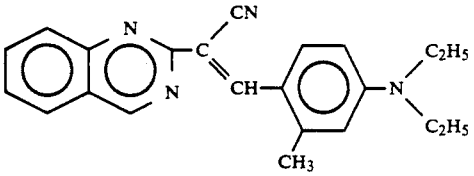

M.W. 342.4

No. 41

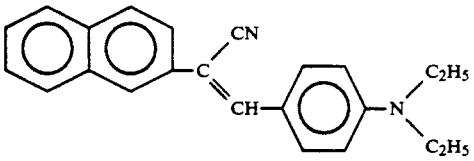

M.W. 326.4

No. 42

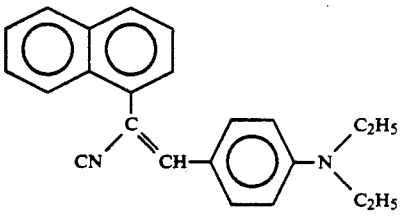

M.W. 326.4

No. 43

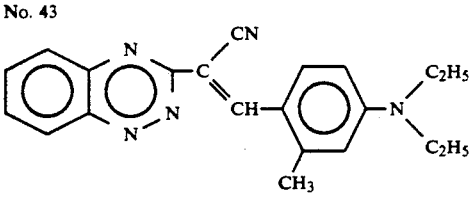

M.W. 343.4

TABLE B-4-continued

No. 44

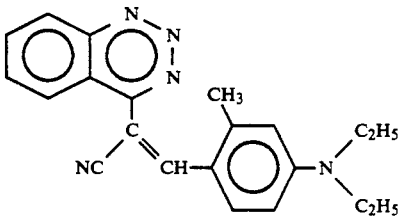

M.W. 343.4

No. 45

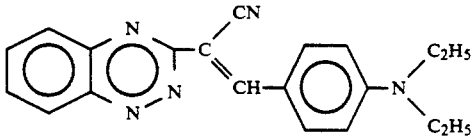

M.W. 343.4

The heat transfer sheet of the second invention can produce an image of yellow or magenta in color. Therefore, when it is used together with a heat transfer sheet capable of producing an image of cyan in color, a full-colored image is obtainable with high reproducibility.

A heat transfer sheet comprising a cyan dye represented by the following formula is suitably used along with the heat transfer sheet of the second invention to produce an excellent full-colored image:

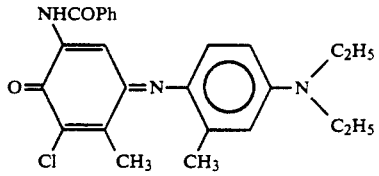

The sublimable dye represented by the formula (III) for use in the heat transfer sheet according to the third invention is readily obtainable by a known method. For example, the dye can be prepared by subjecting a heteroazolone compound represented by the following formula (a), and a nitroso compound represented by the following formula (b) or an aldehyde compound represented by the following formula (c) to a dehydration condensation reaction in the presence of an acid, base, or acid-base catalyst:

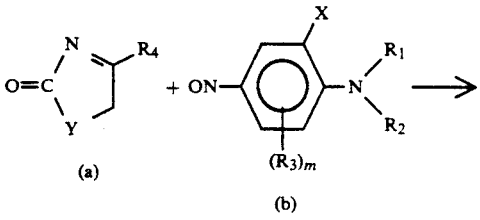

(a) (b)

-continued

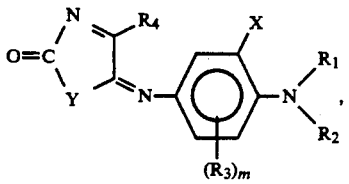

(III)

or

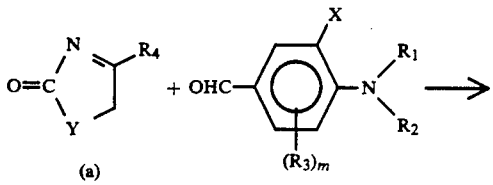

(a) (b)

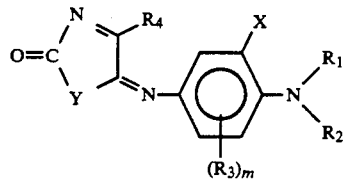

(III)

wherein $R_1$, $R_2$, $R_3$, $R_4$, X, Y, and m are the same as those defined before.

The heteroazolone compound having the above formula (a) is readily obtainable by a known method such as the method described in *Bull. Chem. Soc. Jap.*, 42 (2) 1617 (1969).

Preferred examples of groups represented by $R_1$, $R_2$, $R_3$ and $R_4$ of the formula (III) include alkyl groups such as a methyl group, an ethyl group, a propyl group and a butyl group; alkoxyalkyl groups such as a methoxyethyl group and an ethoxyethyl group; hydroxyalkyl groups such as a hydroxyethyl group and β-hydroxypropyl group; halogenoalkyl groups such as a chloroethyl group; cyanoalkyl groups such as a cyanomethyl group and a cyanoethyl group; cycloalkyl groups such as a cyclohexyl group; aralkyl groups such as a benzyl group and a phenethyl group; aryl groups such as a phenyl group, a tolyl group, a halogenophenyl group and an alkoxyphenyl group; alkoxyl groups such as a methoxy group, an ethoxy group, a propoxy group and a butoxy group; hydrogen; halogens such as chlorine, bromine and iodine; a cyano group; a carboxyl group; acyl groups such as an acetyl group, a propanoyl group and a benzoyl group; acylamino groups such as an acetylamino group and a benzoylamino group; sulfonylamino groups such as a methanesulfonylamino group, an ethanesulfonylamino group and a benzenesulfonylamino group; ureido groups such as a methylureido group, a 1,3-dimethylureido group and an ethylureido group; carbamoyl groups such as a methylcarbamoyl group, an ethylcarbamoyl group and a phenylcarbamoyl group; sulfamoyl groups such as a methylsulfamoyl group, an ethylsulfamoyl group and a phenylsulfamoyl group; amino groups such as a methylamino group, an ethylamino group, a propylamino group, a dimethylamino group and a diethylamino group; and heterocyclic groups such as a furyl group, a thienyl group, a pyrrolyl group, a pyrazolyl group, an imidazolyl group, a pyridyl group, a thiazolyl group and an oxazolyl group.

It is preferable that the molecular weight of the dye for use in the heat transfer sheet of the third invention be in the range of from 300 to 500.

Listed in Table C-1 are specific examples of the dye having the formula (III), which are favorably employed in the heat transfer sheet of the third invention.

TABLE C-1

| No. | X | Y | Z | $R_1$ | $R_2$ | $R_3$ | m | $R_4$ | M. W. |
|---|---|---|---|---|---|---|---|---|---|
| 1 | —H | >S | >N | $-C_2H_5$ | $-C_2H_5$ | $-OC_2H_5$ | 1 | —Ph | 381.5 |
| 2 | —H | >S | >N | $-C_2H_5$ | $-C_2H_5$ | $-OC_2H_5$ | 1 | thienyl | 387.4 |
| 3 | —H | >S | >N | $-C_2H_5$ | $-C_2H_5OH$ | $-OC_2H_5$ | 1 | —Ph | 397.5 |
| 4 | —H | >S | >N | $-C_2H_5$ | $-C_2H_4NHSO_2CH_3$ | $-OC_2H_5$ | 1 | $-C_2H_5$ | 426.6 |
| 5 | —H | >S | >N | $-C_2H_5$ | —Ph | $-CH_3$ | 1 | $-C_2H_5$ | 351.5 |
| 6 | —H | >S | >N | $-C_2H_5$ | $-CH_2Ph$ | $-OC_2H_5$ | 1 | thienyl | 449.5 |
| 7 | —H | >S | >N | $-C_2H_5$ | $-C_2H_5$ | $-NHCOCH_3$ | 1 | —Ph | 394.5 |
| 8 | —H | >S | >N | $-C_2H_5$ | $-C_2H_4CN$ | $-NHCOCH_3$ | 1 | —Ph | 419.5 |

TABLE C-1-continued

| No. | X | Y | Z | $R_1$ | $R_2$ | $R_3$ | m | $R_4$ | M. W. |
|---|---|---|---|---|---|---|---|---|---|
| 9 | —H | >S | >N | $-C_2H_5$ | $-C_2H_5$ | $-OC_2H_5$ | 1 | $-NHCOCH_3$ | 362.5 |
| 10 | —H | >S | >N | $-C_2H_5$ | $-C_2H_5$ | $-NHCOCH_3$ | 1 | furfuryl | 384.4 |
| 11 | —H | >S | >N | $-C_2H_5$ | $-C_2H_5$ | $-OC_2H_5$ | 1 | furfuryl | 371.4 |
| 12 | —H | >S | >CH | $-C_2H_5$ | $-C_2H_5$ | $-OC_2H_5$ | 1 | —Ph | 380.5 |
| 13 | —H | >O | >CH | $-C_2H_5$ | $-C_2H_5$ | $-OC_2H_5$ | 1 | —Ph | 364.5 |
| 14 | —H | >O | >N | $-C_2H_5$ | $-C_2H_5$ | $-OC_2H_5$ | 1 | —Ph | 365.5 |
| 15 | —H | >O | >N | $-C_2H_5$ | $-C_2H_5$ | $-OC_2H_5$ | 1 | thienyl | 371.4 |

The heat transfer sheet of the third invention can produce an image of magenta in color. Therefore, when it is used together with heat transfer sheets which can respectively produce images of yellow and cyan in color, a full-colored image is obtainable with high reproducibility.

The following heat transfer sheets are preferably used along with the heat transfer sheet of the third invention to produce an excellent full-colored image:

(i) A heat transfer sheet comprising a yellow dye represented by the following formula:

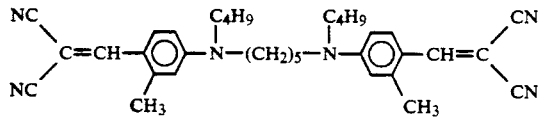

(ii) A heat transfer sheet comprising a cyan dye represented by the following formula:

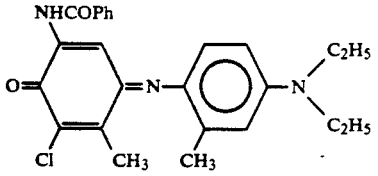

The sublimable dye represented by the formula (IV) for use in the heat transfer sheet according to the fourth invention is readily obtainable by a known method. For example, the dye can be prepared by subjecting a heteroazole compound represented by the following formula (a), and a nitroso compound represented by the following formula (b) or an aldehyde compound represented by the following formula (c) to a dehydration condensation reaction in the presence of an acid, base, or acid-base catalyst:

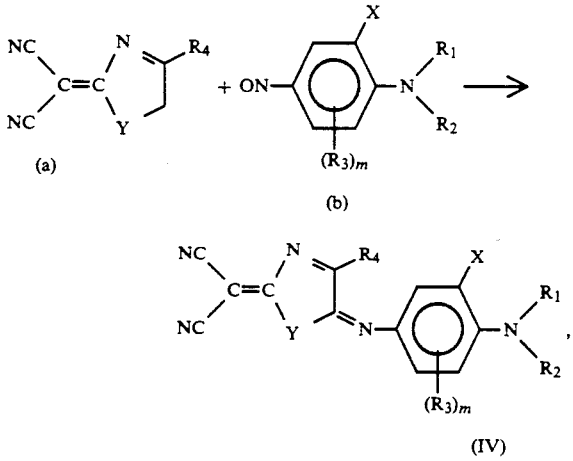

or

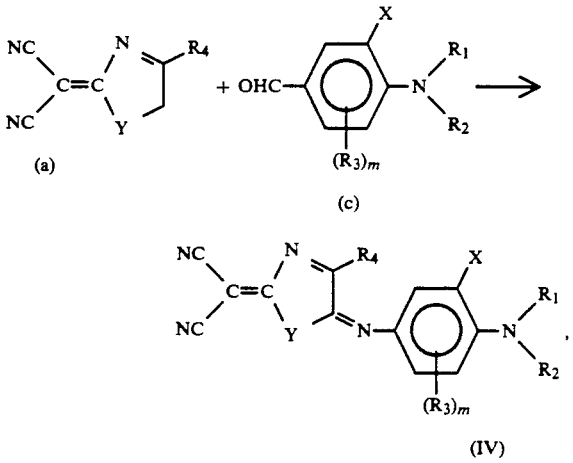

wherein $R_1$, $R_2$, $R_3$, $R_4$, X, Y, and m are the same as those defined before.

The heteroazole compound having the above formula (a) is readily obtainable by a known method such as the method described in *Bull. Chem. Soc. Jap.*, 42 (2) 1617 (1969), or the method described in U.S. Pat. No. 4,371,734.

Preferred examples of groups represented by $R_1$, $R_2$, $R_3$ and $R_4$ of the formula (IV) include alkyl groups such as a methyl group, an ethyl group, a propyl group and a butyl group; alkoxyalkyl groups such as a methoxyethyl group and an ethoxyethyl group; hydroxyalkyl groups such as a hydroxyethyl group and β-hydroxypropyl group; halogenoalkyl groups such as a chloroethyl group; cyanoalkyl groups such as a cyanomethyl group and a cyanoethyl group; cycloalkyl groups such as a cyclohexyl group; aralkyl groups such as a benzyl group and a phenethyl group; aryl groups such as a phenyl group, a tolyl group, a halogenophenyl group and an alkoxyphenyl group; alkoxyl groups such as a methoxy group, an ethoxy group, a propoxy group and a butoxy group; hydrogen; halogens such as chlorine, bromine and iodine; a cyano group; a carboxyl group; acyl groups such as an acetyl group, a propanoyl group and a benzoyl group; acylamino groups such as an acetylamino group and a benzoylamino group; sulfonylamino groups such as a methanesulfonylamino group, an ethanesulfonylamino group and a benzenesulfonylamino group; ureido groups such as a methylureido group, a 1,3-dimethylureido group and an ethylureido group; carbamoyl groups such as a methylcarbamoyl group, an ethylcarbamoyl group and a phenylcarbamoyl group; sulfamoyl groups such as a methylsulfamoyl group, an ethylsulfamoyl group and a phenylsulfamoyl group; amino groups such as a methylamino group, an ethylamino group, a propylamino group, a dimethylamino group and a diethylamino group; and heterocyclic groups such as a furyl group, a thienyl group, a pyrrolyl group, a pyrazolyl group, an imidazolyl group, a pyridyl group, a thiazolyl group and an oxazolyl group.

It is preferable that the molecular weight of the dye for use in the heat transfer sheet of the fourth invention be in the range of from 300 to 500.

Listed in Table D-1 are specific examples of the dye having the formula (IV), which are favorably employed in the heat transfer sheet of the fourth invention.

TABLE D-1

| No. | X | Y | Z | $R_1$ | $R_2$ | $R_3$ | m | $R_4$ | M. W. |
|---|---|---|---|---|---|---|---|---|---|
| 1 | —H | >S | >N | $-C_2H_5$ | $-C_2H_5$ | $-OC_2H_5$ | 1 | —Ph | 429.6 |
| 2 | —H | >S | >N | $-C_2H_5$ | $-C_2H_5$ | $-OC_2H_5$ | 1 | thienyl | 435.5 |
| 3 | —H | >S | >N | $-C_2H_5$ | $-C_2H_5OH$ | $-OC_2H_5$ | 1 | —Ph | 445.6 |
| 4 | —H | >S | >N | $-C_2H_5$ | $-C_2H_4NHSO_2CH_3$ | $-OC_2H_5$ | 1 | $-C_2H_5$ | 474.6 |
| 5 | —H | >S | >N | $-C_2H_5$ | —Ph | $-CH_3$ | 1 | $-C_2H_5$ | 399.5 |
| 6 | —H | >S | >N | $-C_2H_5$ | $-CH_2Ph$ | $-OC_2H_5$ | 1 | thienyl | 497.5 |
| 7 | —H | >S | >N | $-C_2H_5$ | $-C_2H_5$ | $-NHCOCH_3$ | 1 | —Ph | 442.6 |
| 8 | —H | >S | >N | $-C_2H_5$ | $-C_2H_4CN$ | $-NHCOCH_3$ | 1 | —Ph | 467.6 |
| 9 | —H | >S | >N | $-C_2H_5$ | $-C_2H_5$ | $-OC_2H_5$ | 1 | $-NHCOCH_3$ | 410.5 |
| 10 | —H | >S | >N | $-C_2H_5$ | $-C_2H_5$ | $-NHCOCH_3$ | 1 | furyl | 432.5 |
| 11 | —H | >S | >N | $-C_2H_5$ | $-C_2H_5$ | $-OC_2H_5$ | 1 | furyl | 419.5 |
| 12 | —H | >S | >CH | $-C_2H_5$ | $-C_2H_5$ | $-OC_2H_5$ | 1 | —Ph | 428.6 |
| 13 | —H | >O | >CH | $-C_2H_5$ | $-C_2H_5$ | $-OC_2H_5$ | 1 | —Ph | 412.5 |

TABLE D-1-continued

| No. | X | Y | Z | $R_1$ | $R_2$ | $R_3$ | m | $R_4$ | M. W. |
|---|---|---|---|---|---|---|---|---|---|
| 14 | —H | >O | >N | $-C_2H_5$ | $-C_2H_5$ | $-OC_2H_5$ | 1 | —Ph | 413.5 |
| 15 | —H | >O | >N | $-C_2H_5$ | $-C_2H_5$ | $-OC_2H_5$ | 1 | thienyl | 419.4 |

The heat transfer sheet of the fourth invention can produce an image of cyan in color. Therefore, when it is used together with heat transfer sheets which can respectively produce images of yellow and magenta in color, a full-colored image is obtainable with high reproducibility.

The following heat transfer sheets are preferably used along with the heat transfer sheet of the fourth invention to produce an excellent full-colored image:

(i) A heat transfer sheet comprising a yellow dye represented by the following formula:

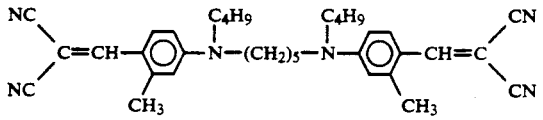

(ii) A heat transfer sheet comprising a magenta dye represented by the following formula:

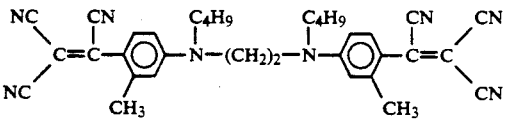

The heat transfer sheet according to the present invention is characterized by comprising the sublimable dye represented by the formula (I), (II), (III) or (IV), and it may have the same structure as that of a conventional heat transfer sheet.

Any known material which has been used as a substrate sheet of a conventional heat transfer sheet is employable as the substrate sheet of the present invention as long as it has proper heat resistance and mechanical strength. For instance, paper, processed paper of various kinds, a polyester film, a polystyrene film, a polypropylene film, a polysulfone film, a polycarbonate film, an aramide film, a polyvinyl alcohol film and cellophane can be used as the substrate sheet. Of these, a polyester film is, in particular, preferred. The thickness of the substrate sheet is approximately from 0.5 to 50 μm, preferably from 3 to 10 μm.

The dye layer formed on one surface of the above substrate sheet is a layer in which the dye having the formula (I), (II), (III) or (IV) is supported by a binder resin.

Any conventional binder resin can be used in the dye layer of the invention. Preferred examples of the binder resin include cellulose resins such as ethyl cellulose, hydroxyethyl cellulose, ethylhydroxy cellulose, hydroxypropyl cellulose, methyl cellulose, cellulose acetate and cellulose butylacetate, and vinyl resins such as polyvinyl alcohol, polyvinyl acetate, polyvinyl butyral, polyvinyl acetacetal, polyvinyl pyrrolidone and polyacrylamide. Of these resins, polyvinyl butyral and polyvinyl acetacetal are preferred from the viewpoints of resistance for heat and transferability of the dye.

The dye layer of the present invention is basically prepared by using the binder resin and the dye having the formula (I), (II), (III) or (IV). The layer, however, may further comprise conventionally known auxiliary components, if necessary.

The dye layer can be prepared in the following manner:

Namely, the dye having the formula (I), (II), (III) or (IV), the binder resin, and the auxiliary components are dissolved or dispersed in a proper solvent. The solution or dispersion thus obtained is coated onto the surface of the substrate sheet, and then dried to form a desired dye layer.

The thickness of the dye layer is approximately from 0.2 to 5.0 μm, preferably from 0.4 to 2.0 μm. The amount of the dye having the formula (I), (II), (III) or (IV) is from 5 to 70 wt. %, preferably from 10 to 60 wt. %, of the total weight of the dye layer.

The heat transfer sheet according to the present invention may further comprise an adhesion-protective layer, that is, a so-called releasing layer on the surface of the dye layer. The releasing layer can prevent the heat transfer sheet from adhering to an image-receiving sheet when heat transfer printing is conducted. Also, the heat transfer sheet comprising the releasing layer can withstand higher temperatures than a heat transfer sheet having no releasing layer, so that a larger amount of thermal energy can be applied thereto when conducting heat transfer printing. As a result, an image with higher density can be obtained.

Even the dye layer simply sprinkled with inorganic powder reveals sufficiently high releasing ability. It is, however, more suitable to provide, as the releasing layer, a layer made of a resin having high releasing ability such as a silicone polymer, an acrylic polymer or a fluorine-containing polymer. In this case, the thickness of the releasing layer is from 0.01 to 5 μm, preferably from 0.05 to 2 μm.

Instead of providing the releasing layer, the inorganic powder or the above-described resin having high releasing ability may be incorporated into the dye layer. Even by such a manner, sufficiently high releasing ability can be imparted to the heat transfer sheet of the present invention.

Furthermore, a heat-resistive layer may be provided on the back surface of the heat transfer sheet of the invention. The heat-resistive layer can eliminate adverse effects of heat which is generated by a thermal head.

Any heat transfer image-receiving sheet which is receptive to the sublimable dye of the formula (I), (II), (III) or (IV) can be used together with the heat transfer sheet of the present invention for image printing. Even those materials which are not receptive to the dye, such as paper, metals, glass and synthetic resins can be used as heat transfer image-receiving sheets if they are provided with a dye-receiving layer on at least one surface of sheets or films of the above materials.

To conduct heat transfer printing by using the heat transfer sheet of the present invention and the above-described heat transfer image-receiving sheet in combination, any conventional means for applying thermal energy is employable. For instance, recording apparatus such as a thermal printer, "Video Printer VY-100" (Trademark) manufactured by Hitachi Co., Ltd., are usable for the purpose. A desired image can be obtained by applying thermal energy, which is controllable by changing the printing time, in an amount of from 5 to 100 mJ/mm$^2$, by the thermal printer to the heat transfer sheet.

The present invention will now be explained more specifically with reference to the following examples, which are given for illustrating of this invention and are not intended to be limiting thereof. Throughout these examples, quantities expressed in "parts" and "percent (%)" are "parts by weight" and "percent by weight", respectively.

REFERENTIAL EXAMPLE A1

3 g of 2-phenyl-5-hydroxy-7-methylimidazopyrimidine was dissolved in a mixture of 300 ml of dimethylformamide and 300 ml of ethylacetate. To the resulting solution were added 7.4 g of potassium carbonate dissolved in 100 ml of water, and 3.4 g of 2-amino-5-diethylaminotoluene dissolved in water. 7.6 g of ammonium peroxosulfate dissolved in 120 ml of water was added dropwise to the above mixture at room temperature while stirring the mixture, followed by a reaction at room temperature for 8 hours. After the reaction was completed, the reaction mixture was cooled, whereby a crystalline precipitate was produced. The precipitate was collected by filtration, thereby obtaining 2.6 g of Dye No. 1 shown in Table A-1. The yield was 49%, and the melting point of the dye was 197° to 198° C.

REFERENTIAL EXAMPLE A2

By using proper starting materials, Dyes Nos. 2 to 30 shown in Table A-1 were respectively prepared in the same manner as described in Referential Example A1.

EXAMPLE A

Preparation of Heat Transfer Sheet

Ink compositions for forming a dye layer, having the following formulation, were respectively prepared by using the above-prepared Dyes No. 1 to No. 30. The ink compositions were respectively coated onto the surface a substrate sheet, a polyethyleneterephthalate film having a thickness of 6 μm, backed with a heat-resistive layer, in an amount of 1.0 g/m$^2$ on dry basis, and then dried, thereby obtaining heat transfer sheets according to the present invention.

Formulation of Ink Composition

| | |
|---|---|
| One of dyes shown in Table A-1 | 3 parts |
| Polyvinylbutyral resin | 4.5 parts |
| Methyl ethyl ketone | 46.25 parts |
| Toluene | 46.25 parts |

It is noted that a proper solvent such as DMF, dioxane, or chloroform was employed when the dye was insoluble in the above ink composition. In the case where the dye could not be thoroughly dissolved in the composition even if such a solvent was used, a filtrate of the composition was employed as the ink composition.

Preparation of Heat Transfer Image-Receiving Sheet

A coating liquid for forming a dye-receiving layer, having the following formulation, was applied onto one surface of a substrate sheet, a sheet of synthetic paper "Yupo FPG #150" (Trademark) manufactured by Oji-Yuka Synthetic Paper Co., Ltd., in an amount of 10.0 g/m$^2$ on dry basis, and then dried at 100° C. for 30 minutes, thereby obtaining a heat transfer image-receiving sheet.

Formulation of Coating Liquid for Forming Dye-Receiving Layer

| | |
|---|---|
| Polyester resin ("Vylon 200" (Trademark) manufactured by Toyobo Co., Ltd.) | 11.5 parts |
| Vinyl chloride - vinyl acetate copolymer ("VYHH" (Trademark) manufactured by Union Carbide Japan K.K.) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Etsu Chemical Co., Ltd.) | 1.2 parts |
| Methyl ethyl ketone/Toluene/Cyclohexanone (weight ratio = 4:4:2) | 102.0 parts |

Printing Test

Each heat transfer sheet was superposed on the heat transfer image-receiving sheet so that the dye layer of the heat transfer sheet faced the dye-receiving layer of the image-receiving sheet. Thermal energy was then applied to the back surface of the heat transfer sheet by a thermal head under the following conditions:

Electric voltage applied: 10 V

Printing time: 4.0 msec

Images thus obtained were respectively evaluated with respect to color density, preservability and color tone in the following manner. The results are shown in Table A-2.

(1) Color Density

The color density of the image was measured by a densitometer "RD-918" (Trademark) manufactured by MacBeth Corporation in U.S.A.

(2) Preservability

The image-receiving sheet in which the image was printed was preserved at 70° C. for 48 hours. After the preservation, the image was visually observed. The evaluation standard is as follows:

◎: Sharpness of the image was unchanged, and even when the surface of the image was rubbed with white paper, the paper was not stained at all with the dye;

○: Sharpness of the image was slightly reduced, and after the above rubbing test, the white paper was found to have been slightly stained with the dye;

Δ: Sharpness of the image was reduced, and after the above rubbing test, the white paper was found to have been stained with the dye; and x: The image was blurred, and after the above rubbing test, the white paper was found to have been considerably stained with the dye.

(3) Color Tone

The color tone of the image was visually observed.

TABLE A-2

| Dye No. | Color Density | Preservability | Color Tone |
|---|---|---|---|
| 1 | 1.82 | ◎ | Green |
| 2 | 1.69 | ◎ | Green |
| 3 | 1.41 | ◎ | Green |
| 4 | 1.51 | ◎ | Green |
| 5 | 1.79 | ◎ | Green |
| 6 | 1.14 | ◎ | Green |
| 7 | 1.45 | ◎ | Green |
| 8 | 1.28 | ◎ | Green |
| 9 | 1.67 | ◎ | Green |
| 10 | 1.07 | ◎ | Green |
| 11 | 1.80 | ◎ | Green |
| 12 | 1.34 | ◎ | Green |
| 13 | 1.21 | ◎ | Green |
| 14 | 1.77 | ◎ | Green |
| 15 | 1.55 | ◎ | Green |
| 16 | 1.94 | ◎ | Green |
| 17 | 1.85 | ◎ | Green |
| 18 | 1.87 | ◎ | Green |
| 19 | 1.72 | ◎ | Green |
| 20 | 1.69 | ◎ | Green |
| 21 | 1.63 | ◎ | Green |
| 22 | 1.54 | ◎ | Green |
| 23 | 1.45 | ◎ | Green |
| 24 | 1.37 | ◎ | Green |
| 25 | 1.29 | ◎ | Green |
| 26 | 1.46 | ◎ | Green |
| 27 | 1.78 | ◎ | Green |
| 28 | 1.66 | ◎ | Green |
| 29 | 1.69 | ◎ | Green |
| 30 | 1.32 | ◎ | Green |

COMPARATIVE EXAMPLE A-1

The procedure in Example A was repeated except that the dye used in Example A was replaced by C.I. Disperse Blue 14, whereby a comparative heat transfer sheet was obtained.

The heat transfer sheet thus obtained was evaluated in the same manner as in Example A. The results are shown in Table A-3.

COMPARATIVE EXAMPLE A-2

The procedure in Example A was repeated except that the dye used in Example A was replaced by C.I. Disperse Blue 134, whereby a comparative heat transfer sheet was obtained.

The heat transfer sheet thus obtained was evaluated in the same manner as in Example A. The results are shown in Table A-3.

COMPARATIVE EXAMPLE A-3

The procedure in Example A was repeated except that the dye used in Example A was replaced by C.I. Solvent Blue 63, whereby a comparative heat transfer sheet was obtained.

The heat transfer sheet thus obtained was evaluated in the same manner as in Example A. The results are shown in Table A-3.

COMPARATIVE EXAMPLE A-4

The procedure in Example A was repeated except that the dye used in Example A was replaced by C.I. Disperse Blue 26, whereby a comparative heat transfer sheet was obtained.

The heat transfer sheet thus obtained was evaluated in the same manner as in Example A. The results are shown in Table A-3.

TABLE A-3

| Comparative Example | Color Density | Preservability |
|---|---|---|
| A-1 | 0.99 | x |
| A-2 | 1.16 | Δ |
| A-3 | 2.07 | x |
| A-4 | 1.12 | Δ |
| A-5 | 1.02 | x |

REFERENTIAL EXAMPLE B1

5.0 g of 2-benzimidazolylacetonitrile was dissolved in a mixture of 100 ml of ethanol and 200 ml of ethylacetate. To the resulting solution were added 27.2 g of sodium carbonate dissolved in 200 ml of water, and 8.5 g of a hydrochloric acid salt of N,N-diethyl-3-methyl-p-phenylenediamine dissolved in 45 ml of water in this order. 49.4 g of ammonium peroxosulfate dissolved in 200 ml of water was added dropwise to the above mixture at room temperature, followed by a reaction at room temperature for 1.5 hours. After the reaction was completed, the produced precipitate was collected by filtration, whereby 6.5 g of a crude crystalline product was obtained. The product was recrystallized from isopropyl alcohol, thereby obtaining 5.5 g of a dye having the following formula:

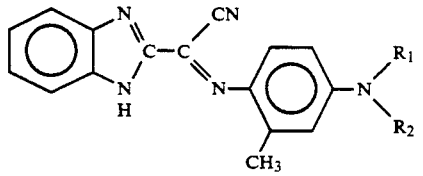

The yield was 52%, and the melting point of the dye thus obtained was 271° to 272° C.

REFERENTIAL EXAMPLE B2

By using proper starting materials, Dyes Nos. 1 to 45 shown in Tables B-1, B-2, B-3, and B-4 were respectively prepared in the same manner as described in Referential Example B1.

EXAMPLE B

Preparation of Heat Transfer Sheet

Ink compositions for forming a dye layer, having the following formulation, were respectively prepared by using the above-prepared Dyes No. 1 to No. 45. The ink compositions were respectively coated onto the surface a substrate sheet, a polyethyleneterephthalate film having a thickness of 6 μm, backed with a heat-resistive layer, in an amount of 1.0 g/m$^2$ on dry basis, and then dried, thereby obtaining heat transfer sheets according to the present invention.

Formulation of Ink Composition

| | |
|---|---|
| One of dyes shown in Tables B-1 to B-4 | 3 parts |
| Polyvinylbutyral resin | 4.5 parts |
| Methyl ethyl ketone | 46.25 parts |
| Toluene | 46.25 parts |

It is noted that a proper solvent such as DMF, dioxane, or chloroform was employed when the dye was insoluble in the above ink composition. In the case where the dye could not be thoroughly dissolved in the composition even if such a solvent was used, a filtrate of the composition was employed as the ink composition.

Preparation of Heat Transfer Image-Receiving Sheet

A coating liquid for forming a dye-receiving layer, having the following formulation, was applied onto one surface of a substrate sheet, a sheet of synthetic paper "Yupo FPG #150" (Trademark) manufactured by Oji-Yuka Synthetic Paper Co., Ltd., in an amount of 10.0 g/m$^2$ on dry basis, and then dried at 100° C. for 30 minutes, thereby obtaining a heat transfer image-receiving sheet.

Formulation of Coating Liquid for Forming Dye-Receiving Layer

| | |
|---|---|
| Polyester resin ("Vylon 200" (Trademark) manufactured by Toyobo Co., Ltd.) | 11.5 parts |
| Vinyl chloride - vinyl acetate copolymer ("VYHH" (Trademark) manufactured by Union Carbide Japan K.K.) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Etsu Chemical Co., Ltd.) | 1.2 parts |
| Methyl ethyl ketone/Toluene/Cyclohexanone (weight ratio = 4:4:2) | 102.0 parts |

Printing Test

Each heat transfer sheet was superposed on the heat transfer image-receiving sheet so that the dye layer of the heat transfer sheet faced the dye-receiving layer of the image-receiving sheet. Thermal energy was then applied to the back surface of the heat transfer sheet by a thermal head under the following conditions:

Electric voltage applied: 10 V

Printing time: 4.0 msec

Images thus obtained were respectively evaluated with respect to color density, preservability and color tone in the following manner. The results are shown in Table B-5.

(1) Color Density

The color density of the image was measured by a densitometer "RD-918" (Trademark) manufactured by MacBeth Corporation in U.S.A.

(2) Preservability

The image-receiving sheet in which the image was printed was preserved at 70° C. for 48 hours. After the preservation, the image was visually observed. The evaluation standard is as follows:

◎: Sharpness of the image was unchanged, and even when the surface of the image was rubbed with white paper, the paper was not stained at all with the dye;

○: Sharpness of the image was slightly reduced, and after the above rubbing test, the white paper was found to have been slightly stained with the dye;

Δ: Sharpness of the image was reduced, and after the above rubbing test, the white paper was found to have been stained with the dye; and x: The image was blurred, and after the above rubbing test, the white paper was found to have been considerably stained with the dye.

(3) Color Tone

The color tone of the image was visually observed.

TABLE B-5

| Dye No. | Color Density | Preservability | Color Tone |
|---|---|---|---|
| 1 | 1.45 | ○ | Red |
| 2 | 2.11 | ○ | Red |
| 3 | 2.36 | ○ | Red |
| 4 | 2.45 | ○ | Red |
| 5 | 2.08 | ◎ | Red |
| 6 | 2.10 | ◎ | Red |
| 7 | 2.26 | ○ | Red |
| 8 | 2.19 | ○ | Red |
| 9 | 2.02 | ○ | Red |
| 10 | 2.71 | ○ | Red |
| 11 | 2.38 | ◎ | Red |
| 12 | 2.41 | ◎ | Red |
| 13 | 2.56 | ◎ | Red |
| 14 | 2.53 | ○ | Red |
| 15 | 2.85 | ○ | Red |
| 16 | 1.44 | ○ | Red |
| 17 | 1.23 | ○ | Red |
| 18 | 1.38 | ○ | Red |
| 19 | 1.15 | ○ | Red |
| 20 | 1.32 | ○ | Red |
| 21 | 1.37 | ○ | Red |
| 22 | 2.34 | ○ | Yellow |
| 23 | 2.05 | ○ | Yellow |
| 24 | 2.23 | ○ | Yellow |
| 25 | 2.33 | ○ | Yellow |
| 26 | 2.13 | ◎ | Yellow |
| 27 | 2.13 | ◎ | Yellow |
| 28 | 2.44 | ○ | Yellow |
| 29 | 2.35 | ○ | Yellow |
| 30 | 2.24 | ○ | Yellow |
| 31 | 2.64 | ○ | Yellowish orange |
| 32 | 2.37 | ◎ | Yellowish orange |
| 33 | 2.33 | ◎ | Yellowish orange |
| 34 | 2.28 | ◎ | Yellowish orange |
| 35 | 2.44 | ○ | Yellowish orange |
| 36 | 2.57 | ○ | Yellowish orange |
| 37 | 1.31 | ○ | Yellow |
| 38 | 1.25 | ○ | Yellow |
| 39 | 1.46 | ○ | Yellowish orange |
| 40 | 1.26 | ○ | Yellow |
| 41 | 1.35 | ○ | Yellow |
| 42 | 1.39 | ○ | Yellow |
| 43 | 1.34 | ○ | Red |
| 44 | 1.42 | ○ | Red |
| 45 | 1.27 | ○ | Yellow |

COMPARATIVE EXAMPLE B-1

The procedure in Example B was repeated except that the dye used in Example B was replaced by C.I. Solvent Yellow 56, whereby a comparative heat transfer sheet was obtained.

The heat transfer sheet thus obtained was evaluated in the same manner as in Example B. The results are shown in Table B-6.

COMPARATIVE EXAMPLE B-2

The procedure in Example B was repeated except that the dye used in Example B was replaced by C.I. Solvent Yellow 14, whereby a comparative heat transfer sheet was obtained.

The heat transfer sheet thus obtained was evaluated in the same manner as in Example B. The results are shown in Table B-6.

COMPARATIVE EXAMPLE B-3

The procedure in Example B was repeated except that the dye used in Example B was replaced by C.I. Disperse Yellow 3, whereby a comparative heat transfer sheet was obtained.

The heat transfer sheet thus obtained was evaluated in the same manner as in Example B. The results are shown in Table B-6.

COMPARATIVE EXAMPLE B-4

The procedure in Example B was repeated except that the dye used in Example B was replaced by C.I. Disperse Yellow 54, whereby a comparative heat transfer sheet was obtained.

The heat transfer sheet thus obtained was evaluated in the same manner as in Example B. The results are shown in Table B-6.

TABLE B-6

| Comparative Example | Color Density | Preservability |
|---|---|---|
| B-1 | 2.32 | x |
| B-2 | 2.19 | x |
| B-3 | 1.75 | x |
| B-4 | 1.48 | x |

REFERENTIAL EXAMPLE C1

2 0 g of 2-phenylthiazolone and 8.0 g of 2-ethoxy-4-diethylaminonitrobenzene were dissolved in 100 ml of toluene, followed by a reaction at room temperature for 3 hours. After the reaction was completed, 150 ml of water was added to the reaction mixture to separate an organic phase. The organic phase was concentrated to obtain crude oil. The crude oil was purified by means of column chromatography, whereby 2.0 g of Dye No. 1 shown in Table C-1 was obtained. The yield was 47%, and the melting point of the dye was 126° to 128° C.

REFERENTIAL EXAMPLE C2

By using proper starting materials, Dyes Nos. 2 to 15 shown in Table C-1 were respectively prepared in the same manner as described in Referential Example C1.

EXAMPLE C

Preparation of Heat Transfer Sheet

Ink compositions for forming a dye layer, having the following formulation, were respectively prepared by using the above-prepared Dyes No. 1 to No. 15. The ink compositions were respectively coated onto the surface a substrate sheet, a polyethyleneterephthalate film having a thickness of 6 μm, backed with a heat-resistive layer, in an amount of 1.0 g/m$^2$ on dry basis, and then dried, thereby obtaining heat transfer sheets according to the present invention.

Formulation of Ink Composition

| | |
|---|---|
| One of dyes shown in Table C-1 | 1 part |
| Polyvinylbutyral resin | 4.5 parts |
| Methyl ethyl ketone | 47.25 parts |
| Toluene | 47.25 parts |

It is noted that a proper solvent such as DMF, dioxane, or chloroform was employed when the dye was insoluble in the above ink composition. In the case where the dye could not be thoroughly dissolved in the composition even if such a solvent was used, a filtrate of the composition was employed as the ink composition.

Preparation of Heat Transfer Image-Receiving Sheet

A coating liquid for forming a dye-receiving layer, having the following formulation, was applied onto one surface of a substrate sheet, a sheet of synthetic paper "Yupo FPG #150" (Trademark) manufactured by Oji-Yuka Synthetic Paper Co., Ltd., in an amount of 10.0 g/m$^2$ on dry basis, and then dried at 100° C. for 30 minutes, thereby obtaining a heat transfer image-receiving sheet.

Formulation of Coating Liquid for Forming Dye-Receiving Layer

| | |
|---|---|
| Polyester resin ("Vylon 200" (Trademark) manufactured by Toyobo Co., Ltd.) | 11.5 parts |
| Vinyl chloride - vinyl acetate copolymer ("VYHH" (Trademark) manufactured by Union Carbide Japan K.K.) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Etsu Chemical Co., Ltd.) | 1.2 parts |
| Methyl ethyl ketone/Toluene/Cyclohexanone (weight ratio = 4:4:2) | 102.0 parts |

Printing Test

Each heat transfer sheet was superposed on the heat transfer image-receiving sheet so that the dye layer of the heat transfer sheet faced the dye-receiving layer of the image-receiving sheet. Thermal energy was then applied to the back surface of the heat transfer sheet by a thermal head under the following conditions:

Electric voltage applied: 10 V

Printing time: 4.0 msec

Images thus obtained were respectively evaluated with respect to color density, preservability and color tone in the following manner. The results are shown in Table C-2.

(1) Color Density

The color density of the image was measured by a densitometer "RD-918" (Trademark) manufactured by MacBeth Corporation in U.S.A.

(2) Preservability

The image-receiving sheet in which the image was printed was preserved at 70° C. for 48 hours. After the preservation, the image was visually observed. The evaluation standard is as follows:

◎: Sharpness of the image was unchanged, and even when the surface of the image was rubbed with white paper, the paper was not stained at all with the dye;

○: Sharpness of the image was slightly reduced, and after the above rubbing test, the white paper was found to have been slightly stained with the dye;

Δ: Sharpness of the image was reduced, and after the above rubbing test, the white paper was found to have been stained with the dye; and x: The image was blurred, and after the above rubbing test, the white paper was found to have been considerably stained with the dye.

(3) Color Tone

The color tone of the image was visually observed.

TABLE C-2

| Dye No. | Color Density | Preservability | Color Tone |
|---|---|---|---|
| 1 | 0.97 | ○ | Purplish Red |
| 2 | 0.97 | ○ | Purplish Red |

TABLE C-2-continued

| Dye No. | Color Density | Preservability | Color Tone |
|---|---|---|---|
| 3 | 0.91 | ∘ | Purplish Red |
| 4 | 0.83 | ∘ | Purplish Red |
| 5 | 1.05 | ∘ | Red |
| 6 | 0.89 | ∘ | Red |
| 7 | 0.98 | ∘ | Purplish Red |
| 8 | 0.92 | ∘ | Purplish Red |
| 9 | 1.08 | ∘ | Red |
| 10 | 0.99 | ∘ | Purplish Red |
| 11 | 1.00 | ∘ | Purplish Red |
| 12 | 1.05 | ∘ | Red |
| 13 | 1.02 | ∘ | Red |
| 14 | 1.00 | ∘ | Purplish Red |
| 15 | 1.04 | ∘ | Purplish Red |

COMPARATIVE EXAMPLE C-1

The procedure in Example C was repeated except that the dye used in Example C was replaced by C.I. Disperse Red 60, whereby a comparative heat transfer sheet was obtained.

The heat transfer sheet thus obtained was evaluated in the same manner as in Example C. The results are shown in Table C-3.

COMPARATIVE EXAMPLE C-2

The procedure in Example C was repeated except that the dye used in Example C was replaced by C.I. Disperse Violet 26, whereby a comparative heat transfer sheet was obtained.

The heat transfer sheet thus obtained was evaluated in the same manner as in Example C. The results are shown in Table C-3.

COMPARATIVE EXAMPLE C-3

The procedure in Example C was repeated except that the dye used in Example C was replaced by C.I. Solvent Red 19, whereby a comparative heat transfer sheet was obtained.

The heat transfer sheet thus obtained was evaluated in the same manner as in Example C. The results are shown in Table C-3.

COMPARATIVE EXAMPLE C-4

The procedure in Example C was repeated except that the dye used in Example C was replaced by C.I. Disperse Red 73, whereby a comparative heat transfer sheet was obtained.

The heat transfer sheet thus obtained was evaluated in the same manner as in Example C. The results are shown in Table C-3.

TABLE C-3

| Comparative Example | Color Density | Preservability |
|---|---|---|
| C-1 | 0.99 | x |
| C-2 | 1.16 | Δ |
| C-3 | 2.07 | x |
| C-4 | 1.12 | Δ |

REFERENTIAL EXAMPLE D1

1.0 g of 2-dicyanomethyl-4-phenylthiazole and 1.2 g of 2-ethoxy-4-diethylaminonitrosobenzene were dissolved in 60 ml of toluene, followed by a reaction at temperatures between 50° C. and 55° C. for 2 hours. After the reaction was completed, the reaction mixture was cooled, whereby a crystalline precipitate was produced. The crude precipitate thus obtained was collected by filtration, and was purified by means of column chromatography, thereby obtaining 1.6 g of Dye No. 1 shown in Table D-1. The yield was 84%, and the melting point of the dye was 248° to 249° C.

REFERENTIAL EXAMPLE D2

By using proper starting materials, Dyes Nos. 2 to 15 shown in Table D-1 were respectively prepared in the same manner as described in Referential Example D1.

EXAMPLE D

Preparation of Heat Transfer Sheet

Ink compositions for forming a dye layer, having the following formulation, were respectively prepared by using the above-prepared Dyes No. 1 to No. 15. The ink compositions were respectively coated onto the surface a substrate sheet, a polyethyleneterephthalate film having a thickness of 6 μm, backed with a heat-resistive layer, in an amount of 1.0 g/m$^2$ on dry basis, and then dried, thereby obtaining heat transfer sheets according to the present invention.

Formulation of Ink Composition

| | |
|---|---|
| One of dyes shown in Table D-1 | 1 part |
| Polyvinylbutyral resin | 4.5 parts |
| Methyl ethyl ketone | 47.25 parts |
| Toluene | 47.25 parts |

It is noted that a proper solvent such as DMF, dioxane, or chloroform was employed when the dye was insoluble in the above ink composition. In the case where the dye could not be thoroughly dissolved in the composition even if such a solvent was used, a filtrate of the composition was employed as the ink composition.

Preparation of Heat Transfer Image-Receiving Sheet

A coating liquid for forming a dye-receiving layer, having the following formulation, was applied onto one surface of a substrate sheet, a sheet of synthetic paper "Yupo FPG #150" (Trademark) manufactured by Oji-Yuka Synthetic Paper Co., Ltd., in an amount of 10.0 g/m$^2$ on dry basis, and then dried at 100° C. for 30 minutes, thereby obtaining a heat transfer image-receiving sheet.

Formulation of Coating Liquid for Forming Dye-Receiving Layer

| | |
|---|---|
| Polyester resin ("Vylon 200" (Trademark) manufactured by Toyobo Co., Ltd.) | 11.5 parts |
| Vinyl chloride - vinyl acetate copolymer ("VYHH" (Trademark) manufactured by Union Carbide Japan K.K.) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Etsu Chemical Co., Ltd.) | 1.2 parts |
| Methyl ethyl ketone/Toluene/Cyclohexanone (weight ratio = 4:4:2) | 102.0 parts |

Printing Test

Each heat transfer sheet was superposed on the heat transfer image-receiving sheet so that the dye layer of the heat transfer sheet faced the dye-receiving layer of the image-receiving sheet. Thermal energy was then applied to the back surface of the heat transfer sheet by a thermal head under the following conditions:

Electric voltage applied: 10 V

Printing time: 4.0 msec

Images thus obtained were respectively evaluated with respect to color density, preservability and color tone in the following manner. The results are shown in Table D-2.

(1) Color Density

The color density of the image was measured by a densitometer "RD-918" (Trademark) manufactured by MacBeth Corporation in U.S.A.

(2) Preservability

The image-receiving sheet in which the image was printed was preserved at 70° C. for 48 hours. After the preservation, the image was visually observed. The evaluation standard is as follows:

◎: Sharpness of the image was unchanged, and even when the surface of the image was rubbed with white paper, the paper was not stained at all with the dye;

○: Sharpness of the image was slightly reduced, and after the above rubbing test, the white paper was found to have been slightly stained with the dye;

Δ: Sharpness of the image was reduced, and after the above rubbing test, the white paper was found to have been stained with the dye; and x: The image was blurred, and after the above rubbing test, the white paper was found to have been considerably stained with the dye.

(3) Color Tone

The color tone of the image was visually observed.

TABLE D-2

| Dye No. | Color Density | Preservability | Color Tone |
|---|---|---|---|
| 1 | 0.76 | ○ | Navy Blue |
| 2 | 0.77 | ○ | Navy Blue |
| 3 | 0.70 | ○ | Navy Blue |
| 4 | 0.65 | ○ | Navy Blue |
| 5 | 0.89 | ○ | Blue |
| 6 | 0.62 | ○ | Blue |
| 7 | 0.79 | ○ | Navy Blue |
| 8 | 0.74 | ○ | Navy Blue |
| 9 | 0.88 | ○ | Blue |
| 10 | 0.83 | ○ | Navy Blue |
| 11 | 0.83 | ○ | Navy Blue |
| 12 | 0.77 | ○ | Blue |
| 13 | 0.86 | ○ | Blue |
| 14 | 0.83 | ○ | Navy Blue |
| 15 | 0.79 | ○ | Navy Blue |

COMPARATIVE EXAMPLE D-1

The procedure in Example D was repeated except that the dye used in Example D was replaced by C.I. Disperse Blue 14, whereby a comparative heat transfer sheet was obtained.

The heat transfer sheet thus obtained was evaluated in the same manner as in Example D. The results are shown in Table D-3.

COMPARATIVE EXAMPLE D-2

The procedure in Example D was repeated except that the dye used in Example D was replaced by C.I. Disperse Blue 124, whereby a comparative heat transfer sheet was obtained.

The heat transfer sheet thus obtained was evaluated in the same manner as in Example D. The results are shown in Table D-3.

COMPARATIVE EXAMPLE D-3

The procedure in Example D was repeated except that the dye used in Example D was replaced by C.I. Solvent Blue 63, whereby a comparative heat transfer sheet was obtained.

The heat transfer sheet thus obtained was evaluated in the same manner as in Example D. The results are shown in Table D-3.

COMPARATIVE EXAMPLE D-4

The procedure in Example D was repeated except that the dye used in Example D was replaced by C.I. Disperse Blue 26, whereby a comparative heat transfer sheet was obtained.

The heat transfer sheet thus obtained was evaluated in the same manner as in Example D. The results are shown in Table D-3.

COMPARATIVE EXAMPLE D-5

The procedure in Example D was repeated except that the dye used in Example D was replaced by C.I. Disperse Violet 4, whereby a comparative heat transfer sheet was obtained.

The heat transfer sheet thus obtained was evaluated in the same manner as in Example D. The results are shown in Table D-3.

TABLE D-3

| Comparative Example | Color Density | Preservability |
|---|---|---|
| D-1 | 0.99 | x |
| D-2 | 1.16 | Δ |
| D-3 | 2.07 | x |
| D-4 | 1.12 | Δ |
| D-5 | 1.02 | x |

All the dyes of the formulae (I), (II), (III) and (IV) for use in the heat transfer sheet according to the present invention have a specific structure containing a substituent at a specific position. The dyes, therefore, have high heat-transferability, are highly dyeable on an image-receiving sheet, and reveal excellent coloring ability, in spite of their extremely high molecular weights as compared with sublimable dyes having molecular weights of approximately from 150 to 250, used for conventional heat transfer sheets. Moreover, the dyes for use in the present invention do not migrate in the image-receiving sheet after transferred thereto, or do not bleed out during preservation thereof.

An image obtained by using the heat transfer sheet of the present invention does not fade when it is exposed to light. Furthermore, the present invention can also eliminate the problem of discoloration of an image which is caused even when it is not directly exposed to light, such as discoloration of an image on a page of a book, or on a sheet preserved in an album or case.

Because of the above-described reasons, an image produced by using the heat transfer sheet of the present invention is excellent in fastness, and resistances for migration, staining and discoloration. Therefore, the image can retain its sharpness and clearness over a prolonged period of time, and does not stain an article which is brought into contact with the image. The present invention can thus successfully overcome various shortcomings resided in the prior art.

What is claimed is:

1. A heat transfer sheet comprising a substrate sheet, and a dye layer which is formed on one surface of the substrate sheet, the dye layer containing a sublimable dye represented by a formula selected from the group consisting of II, III, or IV:

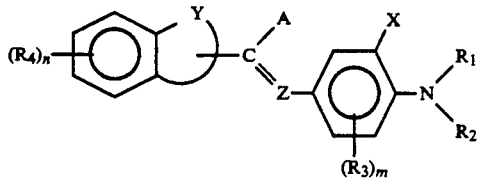
(II)

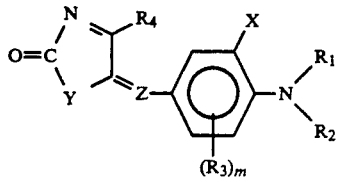
(III)

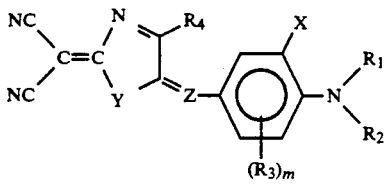
(IV)

wherein $R_1$ and $R_2$, which may be the same or different and may form together a five- or six-membered ring which may contain an oxygen atom or a nitrogen atom, are a substituted or unsubstituted alkyl, cycloalkyl, aralkyl or aryl group;

$R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group;

in formula II, $R_4$ is hydrogen, halogen, a cyano group, a nitro group, or a substituted or unsubstituted alkyl, cycloalkyl, alkoxyl, aralkyl, aryl, heterocyclic, acyl, sulfonyl, acylamino, sulfonylamino, ureido, carbamoyl, sulfamoyl or amino group;

in formulae III and IV, $R_4$ is hydrogen, or a substituted or unsubstituted alkyl, cycloalkyl, alkoxyl, aralkyl, aryl, heterocyclic, acylamino, sulfonylamino or amino group;

X is hydrogen, or an atom or atomic group which forms a five- or six-membered ring together with $R_1$;

in formula II, Y is an aromatic hydrocarbon, or a nitrogen-containing five- or six-membered heterocyclic ring containing 1 to 3 nitrogen atoms;

in formulae III and IV, Y is oxygen, or sulfur;

A is an electron attracting group;

Z is nitrogen, or a methyne group;

m is an integer of 1 or 2; and n is an integer of 1 or 2.

2. A heat transfer sheet comprising a substrate sheet, and a dye layer which is formed on one surface of the substrate sheet, the dye layer containing a sublimable dye represented by the following formula (II):

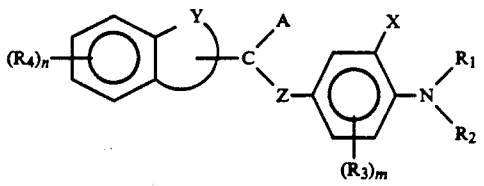
(II)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group;

$R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group;

$R_4$ is hydrogen, halogen, a cyano group, a nitro group, or a substituted or unsubstituted alkyl, cycloalkyl, alkoxyl, aralkyl, aryl, heterocyclic, acyl, sulfonyl, acylamino, sulfonylamino, ureido, carbamoyl, sulfamoyl or amino group;

X is hydrogen, or an atom or atomic group which forms a five- or six-membered ring together with $R_1$;

Y is an aromatic hydrocarbon, or a nitrogen-containing five- or six-membered heterocyclic ring containing 1 to 3 nitrogen atoms;

A is an electron attracting group;

Z is nitrogen, or a methyne group;

m is an integer of 1 or 2; and n is an integer of 1 or 2.

3. A heat transfer sheet according to claim 2, wherein said sublimable dye has a molecular weight of from 300 to 500.

4. A heat transfer sheet comprising a substrate sheet, and a dye layer which is formed on one surface of the substrate sheet, the dye layer containing a sublimable dye represented by the following formula (III):

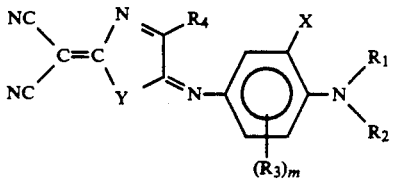
(III)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group;

$R_3$ is hydrogen, halogen, a cyano group, or a substituted or unsubstituted alkyl, cycloalkyl, alkoxyl, aralkyl, aryl, acyl, acylmino, sulfonylamino, ureido, carbamoyl, sulfamoyl or amino group;

$R_4$ is hydrogen, or a substituted or unsubstituted alkyl, cycloalkyl, alkoxyl, aralkyl, aryl, heterocyclic, acylamino, sulfonylamino or amino group;

X is hydrogen, or an atom or atomic group which forms a five- or six-membered ring together with $R_1$;

Y is oxygen, or sulfur;

Z is nitrogen, or a methyne group; and m is an integer of 1 or 2.

5. A heat transfer sheet according to claim 4, wherein said sublimable dye has a molecular weight of from 300 to 500.

6. A heat transfer sheet comprising a substrate sheet, and a dye layer which is formed on one surface of the substrate sheet, the dye layer containing a sublimable dye represented by the following formula (IV):

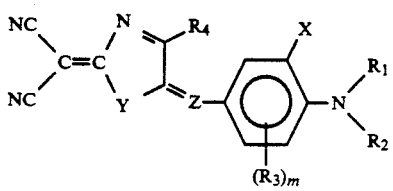

(IV)

wherein $R_1$ and $R_2$, which may be the same or different and may form each other a five- or six-membered ring which may contain an oxygen atom or a nitrogen atom, are a substituted or unsubstituted alkyl, cycloalkyl, aralkyl or aryl group;

$R_3$ is hydrogen, halogen, a cyano group, or a substituted or unsubstituted alkyl, cycloalkyl, alkoxyl, aralkyl, aryl, acyl, acylmino, sulfonylamino, ureido, carbamoyl, sulfamoyl or amino group;

$R_4$ is hydrogen, or a substituted or unsubstituted alkyl, cycloalkyl, alkoxyl, aralkyl, aryl, heterocyclic, acylamino, sulfonylamino or amino group;

X is hydrogen, or an atom or atomic group which forms a five- or six-membered ring together with $R_1$;

Y is oxygen, or sulfur;

Z is nitrogen, or a methyne group; and m is an integer of 1 or 2.

7. A heat transfer sheet according to claim 6, wherein said sublimable dye has a molecular weight of from 300 to 500.

* * * * *